United States Patent [19]

Johnson

[11] Patent Number: 4,928,873

[45] Date of Patent: May 29, 1990

[54] FOLDABLE CUP HOLDER

[76] Inventor: Wayne A. Johnson, P.O. Box 3400, Corpus Christi, Tex. 78463

[21] Appl. No.: 388,344

[22] Filed: Jul. 31, 1989

[51] Int. Cl.[5] ..... B65D 6/18

[52] U.S. Cl. ..... 229/1.5 H; 220/85 H; 248/311.2; 294/31.2

[58] Field of Search ..... 229/1.5 H; 220/4 F, 220/85 H, 903; 206/217; 215/100 R; 294/28, 31.2, 32; 211/71; 248/311.2; 224/42.45 R, 901

[56] References Cited

U.S. PATENT DOCUMENTS

| | | | |
|---|---|---|---|
| 2,385,913 | 10/1945 | Fink | 294/28 |
| 3,193,232 | 7/1965 | Hatcher | 248/311.2 |
| 3,610,409 | 10/1971 | Graf | 248/311.2 |
| 3,615,115 | 10/1971 | Simms | 294/31.2 |
| 3,794,370 | 2/1974 | Lockhart et al. | 294/31.2 |
| 3,967,848 | 7/1976 | Sowle | 229/1.5 H |
| 4,511,167 | 4/1985 | Kawaguchi | 294/28 |
| 4,715,633 | 12/1987 | Brink et al. | 294/31.2 |
| 4,796,936 | 1/1989 | Sherin | 294/31.2 |
| 4,828,211 | 5/1989 | McConnell et al. | 248/311.2 |
| 4,834,438 | 5/1989 | Haidet | 294/31.2 |
| 4,848,625 | 7/1989 | Lucla | 224/901 |

FOREIGN PATENT DOCUMENTS

| | | | |
|---|---|---|---|
| 516354 | 1/1931 | Fed. Rep. of Germany | 248/311.2 |
| 2325248 | 12/1974 | Fed. Rep. of Germany | 224/42.45 R |

*Primary Examiner*—Gary Elkins
*Attorney, Agent, or Firm*—G. Turner Moller

[57] ABSTRACT

A cup holder provides a series of arcuate generally rigid sections pivoted together. The cup receiving section is adjustable to receive cups of different size and can be collapsed to a storage position.

7 Claims, 1 Drawing Sheet

FOLDABLE CUP HOLDER

This invention relates to a holder for beverage cups and more particularly to a foldable cup holder.

More-or-less rigid plastic cup holders are known for receiving and supporting a more flexible and inexpensive beverage cup. This arrangement is common in company coffee bars and the like and has a number of advantages. The cups are relatively inexpensive and are thrown away after use. The cup holders normally do not require washing and are kept at the coffee bar so the overall scheme is inexpensive and requires little clean up effort. The cup holders in use in this arrangement have a downwardly tapering annular rigid body for receiving the cup therein, a plurality of feet on the rigid body for supporting the cup holder on an underlying surface and a D-shaped handle on the rigid body allowing the cup holder to be easily raised and lowered by the user. The cups are also downwardly tapered and may either be more-or-less frustoconical in the case of a sharp taper or more-or-less cylindrical in the case of a gentle taper.

A common incentive or loss leader in the fast food business is to sell a substantial coffee cup or plastic mug to a patron and thereafter refill the cup with coffee or a carbonated soft drink at a nominal charge. Food servers normally refill the cup simply by pouring coffee into the cup. Occasionally, a food server will fill a plastic cup with coffee and set the plastic cup in the refillable glass cup thereby using the refillable cup as a cup holder.

It is known in the prior art to provide cup holders which can be circumferentially adjusted to accommodate cups of different diameter as shown in U.S. Patent No. 4,715,633. A similar arrangement is found in U.S. Patent No. 3,794,370.

In summary, this invention comprises a cup holder having a plurality of pivotally connected rigid arcuate sections which are free to move relative to one another. The free ends of the sections are connectable by a pair of strips, one having a multiplicity of hooks and one having a multiplicity of loops for engagement with the hooks. By pivotally connecting the sections, the cup holder can be folded up into a storage position for easy placement in a user's pocket. In addition, pivotally connecting the sections allows a circumferential adjustment of the cup holder thereby accommodating cups of substantially different size. Each of the sections includes an shoulder or abutment extending inwardly toward a central vertical axis for engaging and supporting the underside of a cup placed in the holder. A handle is rigid with one of the sections and extends away from a central axis of the holder.

It is an object of this invention to provide an improved cup holder.

Another object of this invention is to provide a cup holder having pivotally connected sections allowing the cup holder to be moved to a collapsed or stowage position and allowing the cup holder to receive cups of different size.

Other objects and advantages of this invention will become more fully apparent as this description proceeds, reference being made to the accompanying drawings and appended claims.

IN THE DRAWINGS

Figure 1:
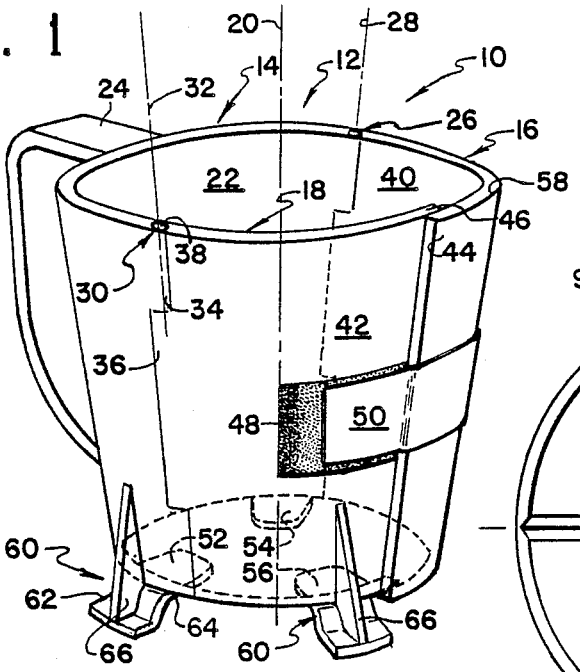
FIG. 1 is an isometric view of a cup holder of this invention illustrated in an expanded or cup receiving position.
Figure 2:
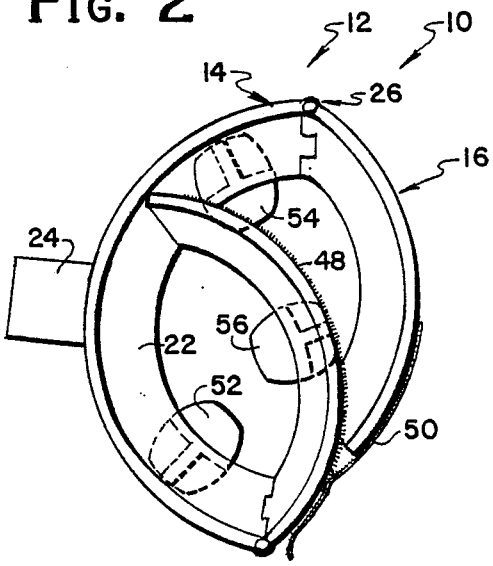
FIG. 2 is a top plan view of the cup holder of FIG. 1 illustrated in a collapsed position.

Referring to FIGS. 1–2, a cup holder 10 of this invention comprises a body 12 having a plurality of arcuate rigid sections 14, 16, 18. The body sections 14, 16, 18 are arcuately concave toward a central vertical axis 20 and preferably converge downwardly in a more-or-less symmetrical fashion. The cup holder 10 may be made of any suitable plastic resin in an injection molding operation.

The body section 14 comprises an arcuate wall 22 providing a handle 24 of any suitable type, such as a conventional D-shaped handle. A first pivotal connection 26 attaches the body section 16 to the arcuate wall 22 for pivotal movement about an axis 28 inclined relative to the central axis 20. A second pivotal connection 30 attaches the body section 18 to the arcuate wall 22 for pivotal movement about an axis 32 inclined relative to the central axis 20. The pivotal connections 26, 30 may be of any suitable type. In one embodiment, the body sections 14, 16, 18 provide a plurality of interdigitating lugs 34, 36 having an aligned opening receiving a pin 38. The pivotal connections 26, 30 thus comprise piano type hinges.

The body sections 16, 18 include arcuate wall sections 40, 42 having the same radius of curvature as the wall section 22. The body sections 16, 18 include free ends 44, 46 which are free to move toward and away from the central axis 20.

A pair of connecting strips 48, 50 releasably secure the free section ends 44, 46 together. The strips 48, 50 may be of any suitable type, such as strips providing a multiplicity of hooks and loops as is provided by a product sold under the trademark VELCRO. The free ends 44, 46 are thus moveable from a collapsed storage position shown in FIG. 2 through an intermediate or small cup receiving position to the large cup receiving position shown in FIG. 1.

The body sections 14, 16, 18 may be of any desired arcuate extent. As shown in FIGS. 1–2, the body section 14 constitutes about half of the circumference of the cup holder 10 while the sections 16, 18 constitute the other half. At the designed diameter of the holder 10, the body sections 16, 18 overlap slightly as shown in FIG. 1. This allows the cup holder 10 to receive cups slightly larger than the design diameter because the overlap may be reduced or eliminated. The cup holder 10 is obviously capable of accepting cups substantially smaller than the design diameter.

The body sections 14, 16, 18 each provide an abutment or shoulder 52, 54, 56 extending inwardly toward the central axis 20 to engage and support the underside of a cup inserted into the top of the holder 10. The hinge axes 28, 32 lie in the arcuate walls 22, 40, 42. The taper of the wall sections 22, 40, 42 is relatively gentle to receive a standard more-or-less cylindrical plastic cup and support the cup on the shoulders 52, 54, 56. A more-or-less frustoconical cup is supported on the inner edge of upper lip 58 of the cup holder 10.

Supporting the body 12 from an underlying surface are a plurality of feet 60. The feet 60 comprise a relatively flat horizontal arcuate pad 62 resting on the underlying surface, a bent upper pad end 64 merging with the body sections 14, 16, 18 and a gusset 66 supporting the flat pad 62. The taper of the wall sections 22, 40, 42 is such that the radially outermost ends of the pad 62 and gusset 66 do not extend beyond the outer edge of the lip 58.

Use of the cup holder 10 should now be apparent. The body sections 16, 18 are pivoted from the stored position of FIG. 2 toward the cup receiving position of FIG. 1. The strips 48, 50 are connected together in the position of FIG. 1 and a cup (not shown) is inserted into the open upper end of the body 12 generally in a path extending along the axis 20 until the bottom of the cup rests on the shoulders 52, 54, 56. When the beverage is finished, the cup (not shown) is removed from the holder 10 and discarded. The strips 48, 50 are detached and the body sections 16, 18 folded toward the stored position of FIG. 2.

Figure 3:
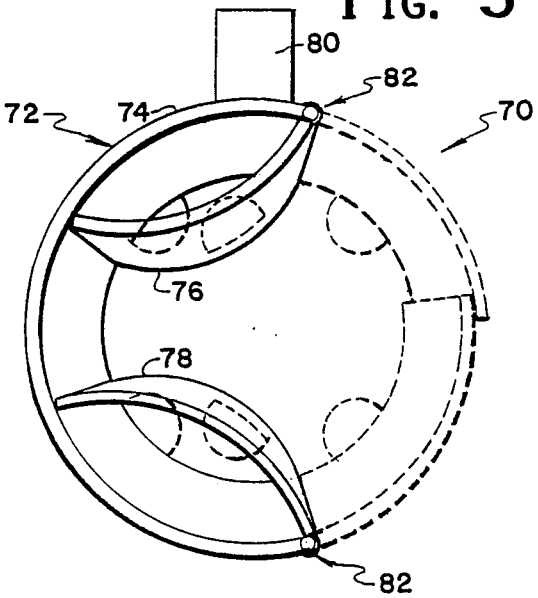

Referring to FIG. 3, there is illustrated another embodiment 70 of this invention comprising a body 72 having a plurality of arcuate rigid sections 74, 76, 78. The cup holder 70 differs from the cup holder 10 in two respects. The section 74 is slightly larger and the handle 80 extends away from the body 72 from a location near one of the connecting means 82. These changes allow the cup holder 70 to collapse to a configuration somewhat different than the cup holder 10.

In the collapsed position of FIG. 2, the cup holder 10 is about 25% shorter than its cup holding configuration in a direction parallel to the handle and the same dimension perpendicular thereto. In the collapsed position of FIG. 2, the cup holder 10 is about as wide as it is long. In FIG. 3, the minimum dimension of the cup holder 70 is substantially less than the minimum dimension of the cup holder 10. In addition, the cup holder 70 is more rectangular because its minimum dimension is much shorter than the dimension parallel to the handle 80. Thus, the cup holder 70 more conveniently fits into a user's pocket.

Figure 4:
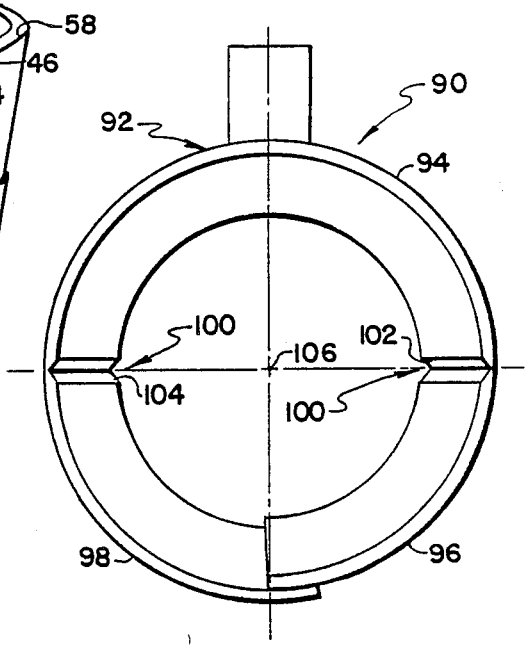
FIGS. 3 and 4 are top plan views illustrating other embodiments of this invention.

Referring to FIG. 4, there is illustrated another embodiment 90 of this invention comprising a body 92 having a plurality of arcuate rigid sections 94, 96, 98. The cup holder 90 differs from the cup holder 10 in only one respect. Instead of a piano hinge arrangement, the means connecting the rigid sections 94, 96, 98 comprises a live hinge 100 which is simply a section 102 of reduced thickness between the rigid section 94 and the rigid sections 96, 98 providing an elongate notch 104 inclined to the axis 106 of the cup holder 90. The notch 104 is conveniently V-shaped and provides for pivotal movement of the sections 96, 98 relative to the section 94 in a manner understood by those skilled in the art.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A foldable cup holder comprising a body comprising a plurality of rigid sections in a closed generally circular path and having adjacent sides, means pivotally connecting all but two of the adjacent sides leaving a pair of pivotally movable sections providing free section ends;

separable closing means carried by the two adjacent sides for releasably securing the free section end together;

means on the sections providing a support for a cup positionable in the closed path;

means on the sections for supporting the sections on an underlying surface; and a handle connected to one of the rigid sections.

2. The foldable cup holder of claim 1 wherein the body sections are smoothly arcuate and define a downwardly converging cup receiving surface when the separable closing means secure the free section ends together.

3. The foldable cup holder of claim 2 wherein the means providing a support for a cup comprises an abutment on the body sections extending from the body sections toward a central vertical axis.

4. The foldable cup holder of claim 2 wherein the body sections provide upper and lower ends, the means supporting the sections on an underlying surface comprise a plurality of feet adjacent the body section lower ends extending away from the vertical axis and providing a terminal end, the terminal end extending no further from the vertical axis than the body section upper end.

5. The foldable cup holder of claim 1 wherein the separable closing means comprises first and second overlapping strips, the first strip comprising a plurality of hooks and the second strip comprising a plurality of loops.

6. The foldable cup holder of claim 1 wherein there are three body sections, the handle being secured to a central one of the body sections, the pivotal connecting means connecting a second of the body sections to a first side of the central body section and connecting a third of the body sections to a second side of the central body section.

7. The foldable cup holder of claim 1 wherein the body provides a central vertical axis and the pivotal connecting means pivotally mounts each movable sections for movement about an axis diverging upwardly relative to the central vertical axis.

* * * * *